US010900286B2

(12) United States Patent
Engle

(10) Patent No.: US 10,900,286 B2
(45) Date of Patent: Jan. 26, 2021

(54) APPARATUS AND METHOD FOR DRILLING GENERALLY HORIZONTAL UNDERGROUND BOREHOLES

(71) Applicant: Barbco, Inc., East Canton, OH (US)

(72) Inventor: Derik Engle, Lesage, WV (US)

(73) Assignee: Barbco, Inc., East Canton, OH (US)

( * ) Notice: Subject to any disclaimer, the term of this patent is extended or adjusted under 35 U.S.C. 154(b) by 0 days.

(21) Appl. No.: 16/200,042

(22) Filed: Nov. 26, 2018

(65) Prior Publication Data

US 2019/0093430 A1 Mar. 28, 2019

Related U.S. Application Data

(63) Continuation of application No. 14/908,330, filed as application No. PCT/US2015/018847 on Mar. 5, 2016, now Pat. No. 10,180,031.

(60) Provisional application No. 61/948,798, filed on Mar. 6, 2014.

(51) Int. Cl.

| | |
|---|---|
| ***E21B 7/00*** | (2006.01) |
| ***E21B 7/04*** | (2006.01) |
| ***E21B 7/28*** | (2006.01) |
| ***E21B 7/20*** | (2006.01) |
| ***E21B 10/60*** | (2006.01) |

(52) U.S. Cl.

CPC ..... *E21B 7/005* (2013.01); *E21B 7/046* (2013.01); *E21B 7/20* (2013.01); *E21B 7/28* (2013.01); *E21B 10/602* (2013.01)

(58) Field of Classification Search

CPC . E21B 7/005; E21B 7/046; E21B 7/20; E21B 7/28; E21B 10/602

See application file for complete search history.

(56) References Cited

U.S. PATENT DOCUMENTS

| | | | | |
|---|---|---|---|---|
| 1,932,068 | A | | 10/1933 | Englebright et al. |
| 3,902,563 | A | | 9/1975 | Dunn |
| 3,920,090 | A | | 11/1975 | McQueen et al. |
| 4,043,136 | A | | 8/1977 | Cherrington |
| 4,117,895 | A | | 10/1978 | Ward et al. |
| 4,280,571 | A | | 7/1981 | Fuller |
| 4,787,465 | A | | 11/1988 | Dickinson, III et al. |
| 4,809,793 | A | | 3/1989 | Hailey |
| 4,828,050 | A | | 5/1989 | Hashimoto |
| 5,255,750 | A | | 10/1993 | Wilkes, Jr. et al. |
| 5,314,267 | A | | 5/1994 | Osadchuk |
| 5,355,967 | A | | 10/1994 | Mueller et al. |
| 5,375,669 | A | * | 12/1994 | Cherrington ..... E21B 7/28 175/102 |
| 5,437,500 | A | | 8/1995 | Lehmann et al. |
| 5,711,385 | A | | 1/1998 | Brotherton |
| 6,142,246 | A | | 11/2000 | Dickinson, III et al. |
| 6,237,701 | B1 | | 5/2001 | Kolle et al. |
| 6,682,264 | B1 | | 1/2004 | McGillis |

(Continued)

*Primary Examiner* — Aaron L Lembo

(74) *Attorney, Agent, or Firm* — Sand, Sebolt & Wernow Co., LPA

(57) ABSTRACT

An apparatus and method for drilling an underground borehole is presented, wherein pressurized air may be used to discharge out of the borehole cuttings created by a cutter head. A casing may be secured to the cutter head such that the cutter head and casing may be rotatable together as a unit. The casing may have larger and smaller diameter sections. An auger may be disposed adjacent the front of the casing.

22 Claims, 9 Drawing Sheets

(56) References Cited

U.S. PATENT DOCUMENTS

| | | | | |
|---|---|---|---|---|
| 6,902,014 | B1 | 6/2005 | Estes | |
| 7,114,583 | B2 | 10/2006 | Chrisman | |
| 7,389,831 | B2 | 6/2008 | Mullins et al. | |
| 7,484,574 | B2 | 2/2009 | Burnett et al. | |
| 7,493,969 | B2 | 2/2009 | Burnett et al. | |
| 7,845,432 | B2 | 12/2010 | Salins et al. | |
| 8,113,741 | B1 | 2/2012 | Vidovic et al. | |
| 8,151,906 | B2 | 4/2012 | Salins et al. | |
| 8,256,536 | B2 | 9/2012 | Harrison et al. | |
| 8,439,132 | B2 | 5/2013 | Salins et al. | |
| 8,567,530 | B2 | 10/2013 | Barbera | |
| 10,465,460 | B2 * | 11/2019 | Barbera | E21B 7/201 |
| 10,526,846 | B2 * | 1/2020 | Barbera | E21B 7/20 |
| 2009/0152008 | A1 | 6/2009 | Salins et al. | |
| 2009/0152010 | A1 | 6/2009 | Salins et al. | |
| 2009/0152012 | A1 | 6/2009 | Salins et al. | |
| 2009/0288883 | A1 | 11/2009 | Barbera | |
| 2009/0301783 | A1 | 12/2009 | Salins | |
| 2011/0209921 | A1 | 9/2011 | Barbera | |
| 2012/0241221 | A1 | 9/2012 | Salins et al. | |
| 2016/0160566 | A1 | 6/2016 | Engle | |

* cited by examiner

APPARATUS AND METHOD FOR DRILLING GENERALLY HORIZONTAL UNDERGROUND BOREHOLES

CROSS REFERENCE TO RELATED APPLICATION

This application is a Continuation of U.S. patent application Ser. No. 14/908,330 filed Jan. 28, 2016, which is a National Stage Entry of PCT/US2015/018847, having an international filing date of Mar. 5, 2015, which applications claims the benefit of U.S. Provisional Application Ser. No. 61/948,798, filed Mar. 6, 2014, the entire disclosures of which are incorporated herein by reference.

BACKGROUND OF THE INVENTION

Technical Field

The invention relates generally to apparatus and methods for drilling generally horizontal boreholes. Compressed air may be used to facilitate removal of the cuttings or spoil from the borehole, and a reduced diameter casing may be used to drive rotation of a cutting head.

Background Information

Underground boring machines have been used for decades in the drilling of generally horizontal boreholes, which may include boreholes which are substantially straight and those which are arcuate for the primary purpose of avoiding or bypassing an obstacle. Often such boreholes are formed by initially drilling or otherwise forming a pilot hole of a generally smaller diameter, followed by the use of an enlarged cutting head which follows the path of the pilot hole in order to enlarge the borehole. In some cases, it may take only one pass in addition to the pilot hole to create the desired final diameter of the borehole. In other cases, additional enlarged cutting devices may be used to drill as many passes as necessary to achieve the desired diameter of the borehole.

Many of the boring machines utilize an auger which is rotated in order to force the cuttings or spoil to be removed from the borehole. Such augers may be disposed in a casing and have an outer diameter which is slightly smaller than that of the inner diameter of the casing in which it is disposed. Drilling fluid or mud is often pumped into the borehole either within a casing or external to a casing in order to facilitate the cutting process and removal of the cuttings. Drilling fluids or lubricants may involve water, bentonite or various types of polymers, etc. The use of certain types of drilling fluids may present environmental hazards and may be prohibited by environmental laws or regulations in certain circumstances. The inadvertent return of drilling lubricant, sometimes referred to as "frac-out", may be of concern when the drilling occurs, for example, under sensitive habitats or waterways. Although bentonite is non-toxic, the use of a bentonite slurry may be harmful to, for example, aquatic plants and fish and their eggs, which may be smothered by the fine bentonite particles when discharged into waterways.

As noted above, many underground boring systems utilize augers to remove the cuttings from the borehole. Such augers are typically formed in sections, which are sequentially added rearwardly as the borehole becomes longer and can accommodate additional auger sections. Given that many boreholes may be several hundred feet long, an auger of such length adds a substantial amount of weight and frictional resistance to the rotation thereof. There is a need in the art for improvements with respect to the above-noted problems.

SUMMARY

In one aspect, the invention may provide a method comprising steps of rotating and moving forward a cutter head and a casing extending rearwardly from the cutter head to cut an underground borehole; and moving pressurized air rearwardly through a cutter head air passage formed in the cutter head and a casing cuttings passage formed in the casing to discharge cuttings created by the cutter head out of a rear end of the casing.

In another aspect, the invention may provide an apparatus comprising an earth-boring cutter head; a cutter head air passage extending through the cutter head; a casing secured to the cutter head and extending rearwardly therefrom so that the casing and cutter head are rotatable together as a unit, the casing having a casing front end and a casing back end; a casing cuttings passage which extends from adjacent the casing front end to adjacent the casing back end and which is in fluid communication with the cutter head air passage; and an entrance opening of the casing cuttings passage which is adjacent the cutter head, spaced from the cutter head air passage and adapted to allow cuttings to move through the entrance opening into the casing cuttings passage.

In another aspect, the invention may provide an apparatus comprising an earth-boring cutter head; a casing segment secured to the cutter head and extending rearwardly therefrom so that the casing and cutter head are rotatable together as a unit, the casing having a casing segment front end and a casing segment back end; wherein the casing segment includes a front portion and a rear portion; the front portion has a first diameter; and the rear portion has a second diameter smaller than the first diameter such that a difference between the first and second diameters is at least four inches; a casing segment cuttings passage which extends from adjacent the casing segment front end to the casing segment back end; and an entrance opening of the casing segment cuttings passage which is adjacent the cutter head and adapted to allow cuttings to move through the entrance opening into the casing cuttings passage.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Figure 1:
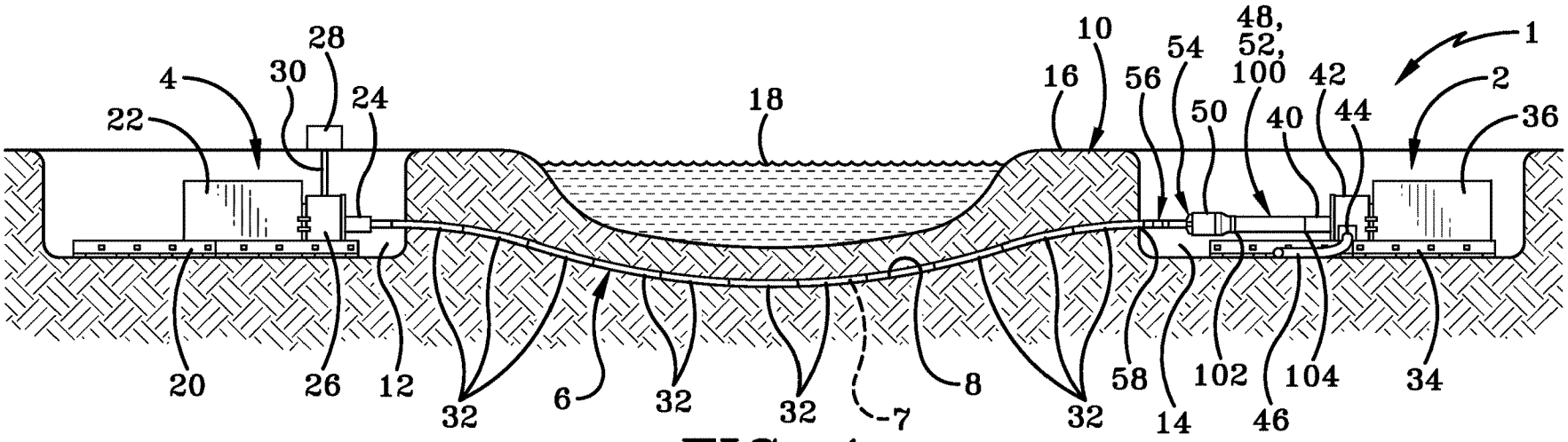
FIG. 1 is a diagrammatic side elevation view of a horizontal directional drilling system with the ground shown in section to illustrate a pilot hole formed in the ground with the pilot tube remaining within the pilot hole.

FIG. 1 shows a sample earth-boring or horizontal directional drilling (HDD) apparatus or system 1 which may include an HDD rig 2 and a pilot tube drive rig or pilot tube control rig 4. Pilot tube drive rig 4 may be configured to drive or control a pilot tube or drill string 6 to drill or otherwise form a pilot hole 8 in the ground or earth 10 extending from one station or pit 12 to another station or pit 14 generally adjacent and below the ground surface 16 of ground 10 and possibly below a surface obstacle 18 shown here in the form of a waterway such as a stream, river, pond or lake although obstacle 18 may also represent many other types of obstacles such as roads, buildings, walls, trees and so forth such that trenchless or HDD drilling is desirable. Pilot hole 8 (and the larger diameter borehole discussed later herein) may have a substantial length which may be, for instance, at least 50, 100, 150, 200, 250 or 300 feet or more. Thus, station 12 and rig 2 are distal station 14 and rig 4 and may be separated by such lengths or distances.

Pilot drive or control rig 4 may include tracks 20 which may be rigidly secured to ground 10 at station 12 which may be within a pit 12. While tracks 20 are shown as being horizontal, they may be angled relative to horizontal so that the pilot hole 8 at its end adjacent station 12 is at an angle to horizontal. Rig 4 may also include an engine 22 which is mounted on tracks 20 and has a rotational output/pilot tube connector 24, which may pass through an air connection swivel 26. Engine 22, connector 24 and swivel 26 are movable back and forth in a forward and rearward direction as shown at Arrow A in FIG. 7 along tracks 20 relative to tracks 20 and the ground. Air compressor 28 may be positioned adjacent station 12 with an air hose or conduit 30 extending between and connected to air compressor 28 and swivel 26 such that air compressor 28 is in fluid communication with a pilot tube air passage 7 (FIGS. 1, 7) formed in pilot tube 6 and extending from one end (a first or front end) of the pilot tube to the other end (a second, rear or back end) of the pilot tube, that is along the entire length of pilot tube 6. The first or front end of pilot tube 6 is in or adjacent pit/station 12 and the second or back end of pilot tube 6 is in or adjacent pit/station 14, whereby compressor 28 is in fluid communication with passage 7 via the front end of pilot tube 6. Pilot tube 6 is made up of a plurality of pilot tube segments 32 which are connected to one another in an end-to-end fashion and are removable from one another. For instance, each adjacent pair of segments 32 may be joined to one another by a threaded engagement or other removable connections known in the art. Each of segments 32 may define air passages extending from the front end to the rear end thereof such that each of the pilot tube segment passages are in fluid communication with one another to form pilot tube air passage 7.

HDD rig 2 may include tracks 34 which are secured to ground 10. While tracks 34 are shown as being horizontal, they may be angled relative to horizontal so that the pilot hole at its end adjacent station 14 extends at an angle to horizontal. Rig 4 may further include an engine 36 having a rotational output 38 (FIG. 3) with a connector 40 which is coupled to output 38 for rotation therewith. Connector 40 may also be referred to as a casing segment or rearmost casing segment 40. Rig 4 may further include a front discharge box 42 with casing segment 40 extending from within box 42 forward and out of box 42. Box 42 may have an outlet or exit port 44 and which may have connected to it a discharge hose or conduit 46. Casing segment 40 may be part of a casing 48 having a larger diameter front section 50 and a smaller diameter rear section 52. An earth-boring cutter head 54 may be mounted at the front of front or forward section 50 with a swivel 56 extending between and connected to the front of the cutter head 54 and a rear end 58 of pilot tube 6. HDD rig 2 is movable back and forth in a forward and rearward direction as shown at Arrow B in FIG. 7 along tracks 34, which include the back and forth movement of engine 36, housing or box 42, connector 40 and hose 46 relative to tracks 34 and ground 10.

Figure 2:
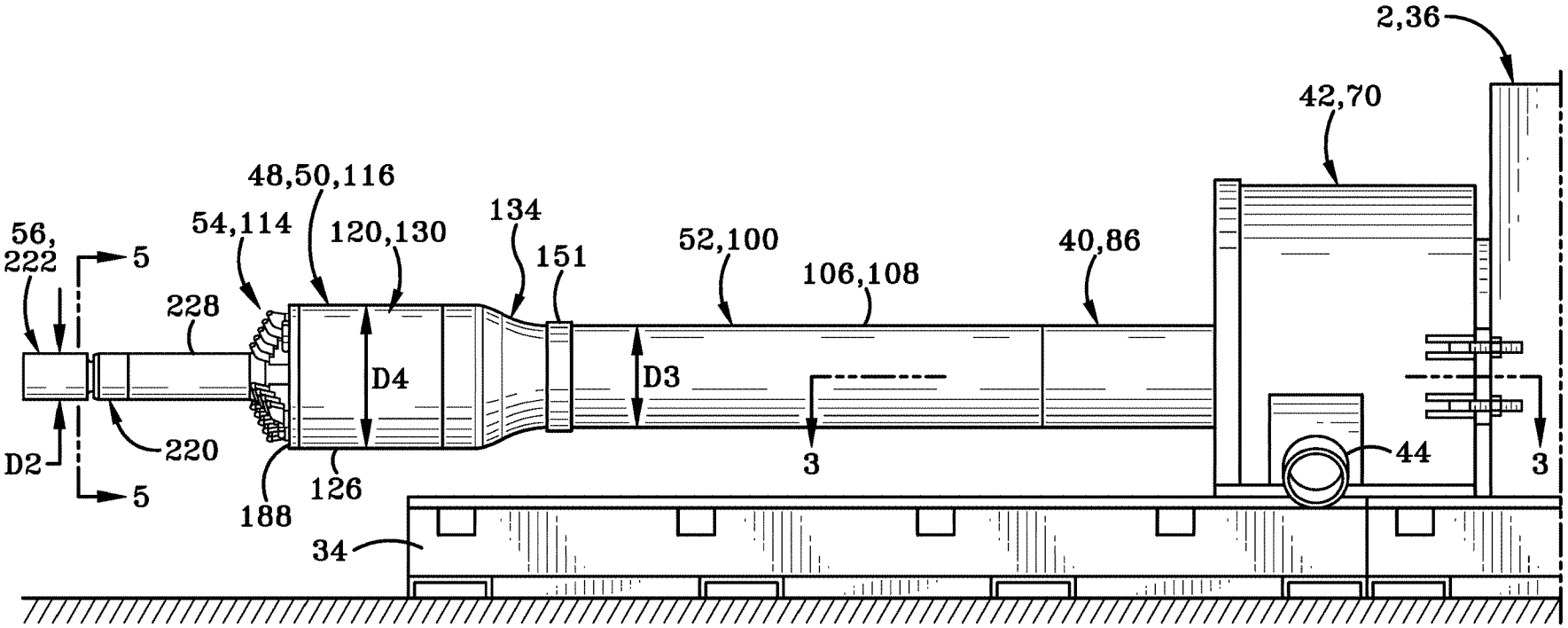
FIG. 2 is a side elevational view showing a reamer or reaming assembly extending forward from a power drive of a horizontal directional drilling rig.

Pilot tube 6 may have an outer diameter D1 (FIG. 7) defined by its cylindrical outer perimeter or outer surface. As shown in FIG. 2, swivel 56 may have an outer diameter D2 defined by its cylindrical outer surface or outer perimeter, rearward section 52 of casing 48 may have an outer diameter D3 defined by its cylindrical outer surface or outer perimeter, and section 50 may have an outer diameter D4 defined by its cylindrical outer surface or outer perimeter. Diameter D2 may be the same as or essentially the same as diameter D1. Diameter D3 may be substantially larger than diameters D1 and D2, and diameter D4 substantially larger than diameter D3. The difference between diameters D4 and D3 is usually at least four inches and may be substantially more than that. For instance, the difference between diameters D4 and D3 may be at least 4, 5, 6, 7, 8, 9, 10, 11, 12, 18, 24, 30 or 36 inches or may fall within a range of about 4, 5, 6, 7, 8, 9, 10, 11 or 12 inches to about 8, 9, 10, 11, 12, 18, 24, 30 or 36 inches. There may be a ratio of diameter D4 to diameter D3 which is at least 1.2:1, 1.3:1, 1.4:1, 1.5:1, 1.6:1, 1.7:1, 1.8:1, 1.9:1, 2:1, 2.5:1, 3:1, 3.5:1 or 4:1, or said ratio may fall within a range of about 1.2:1, 1.3:1, 1.4:1, 1.5:1, 1.6:1, 1.7:1, 1.8:1, 1.9:1 or 2:1 to about 1.6:1, 1.7:1, 1.8:1, 1.9:1, 2:1, 2.5:1, 3:1, 3.5:1 or 4:1.

Figure 3:
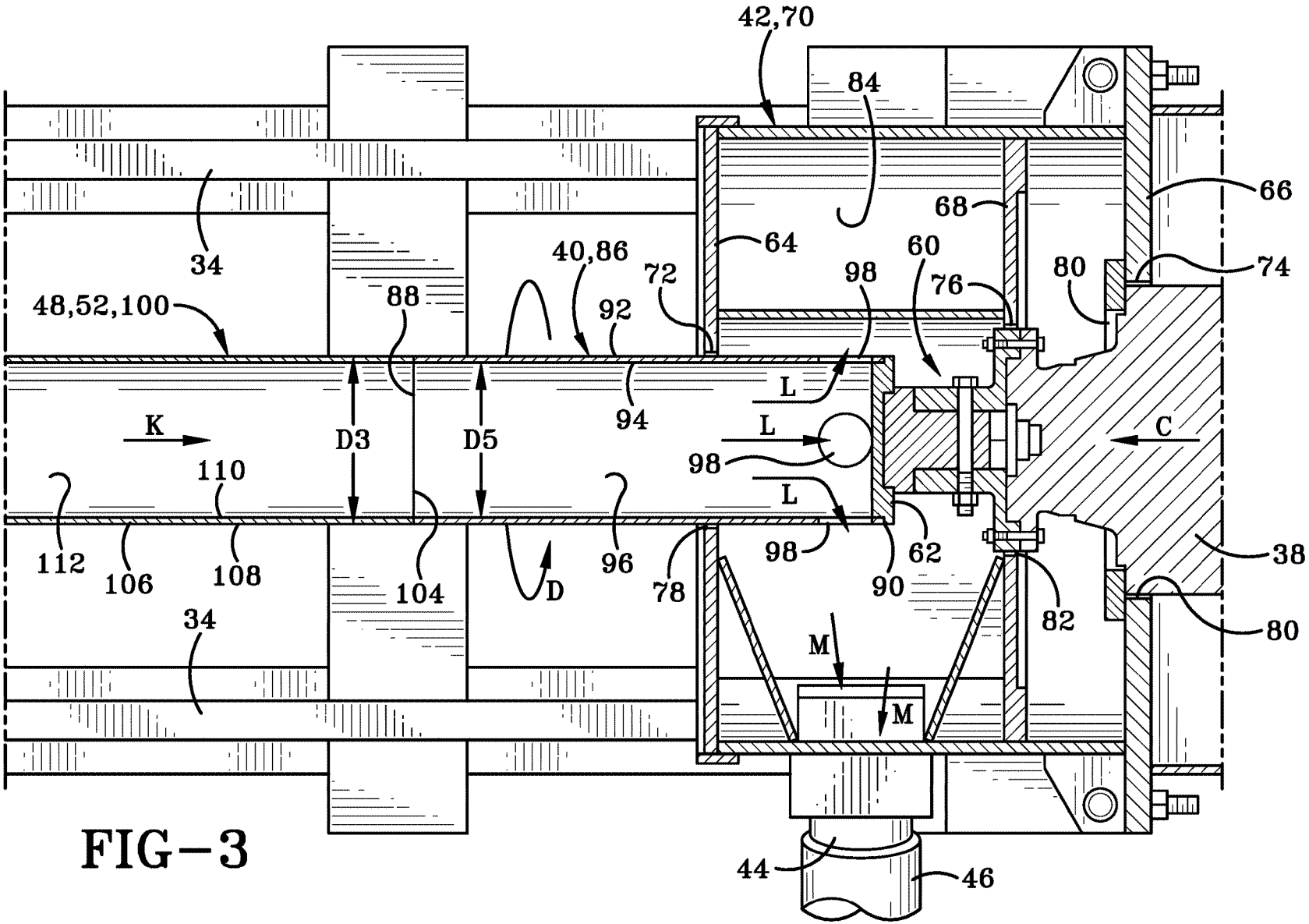
FIG. 3 is a sectional view taken on line 3-3 of FIG. 2 showing in part the inside of the rear end of the smaller diameter casing and the interior chamber of the front box of the power drive.

With primary reference to FIG. 3, a coupler 60 may extend between and be secured to the front of rotational output or drive shaft 38 and a rear end of casing segment 40. Coupler 60 thus secures the rear end of segment 40 to the front of output 38 in order to translate rotational movement of output 38 to casing segment 40 and all of the casing 48 and cutter head 54 and one portion of swivel 56. Coupler 60 may include or be secured to an end cap, pushing plate or pushing cap 62 which contacts the rear end of casing segment 40 and covers the air passage defined by segment 40 which extends from its front end to its rear end. Coupler 60 thus translates the forward movement of output 38 (Arrow C) to casing segment 40 and the entire casing 48, cutter head 54, swivel 56 and pilot tube 6 when connected to the front of swivel 56. This forward movement of the rotational output 38 and coupler 60 and so forth would occur during the forward movement of rig 2 along tracks 34.

Coupler 60 may have any suitable configuration and may include various fasteners such as bolts as shown in FIG. 3. Drive shaft 36, coupler 60, cap 62, connector 40 and casing 48 may serve as a drive train extending between engine 36 and cutter head 54 for pushing and driving rotation of cutter head 54.

Box 42 may include an annular front wall 64, an annular back wall 66 and an annular intermediate wall 68 which is rearward of front wall 64 and forward of back wall 66. Box 42 may further include a cylindrical sidewall 70 such that each of walls 64, 66 and 68 are secured to sidewall 70 and extend radially inwardly therefrom to respective inner perimeters 72, 74 and 76 which respectively define openings or holes 78, 80 and 82 each of which extends from the front to the back of the given wall 64, 66 and 68. Hole 78 has an inner diameter defined by inner perimeter 72 which is slightly larger than outer diameter D3. Thus, the outer diameter or surface of casing segment 40 is closely adjacent inner perimeter 72 inasmuch as segment 40 extends through hole 78 with a portion of segment 40 extending forward of front wall 64 and a portion of segment 40 extending within an interior chamber 84 of box 2 defined within walls 64, 68 and 70. An annular seal may be positioned adjacent inner perimeter 72 to form a seal between front wall 64 and the outer surface of casing segment 40. Drive shaft or output 38 extends through hole 80 while output 38 and/or coupler 60 may extend through hole 82. An annular seal may be positioned adjacent inner perimeter 74 to provide a seal between wall 66 and shaft 38. Likewise, an annular seal may be provided along inner perimeter 76 to provide a seal between wall 68 and shaft 38 and/or coupler 60. Port 44 is in fluid communication with interior chamber 84, as is the passage defined by hose 46 which is connected at one end thereof to port 44 and extends outwardly therefrom to a discharge end.

With continued reference to FIG. 3, casing segment 40 includes a cylindrical sidewall 86 having a front end 88, a back end 90 and cylindrical outer and inner surfaces 92 and 94 extending from front end 88 to back end 90. Outer surface 90 may define an outer diameter which is the same as outer diameter D3 of the rear section 52. Inner surface 94 may define an inner diameter D5 which may serve as the inner diameter of rear section 52 from the front to the rear end thereof. Inner surface 94 defines a cuttings passage 96 which extends from front end 88 to adjacent back end 90. Passage 96 may be referred to as a connector cuttings passage or rearmost casing segment cuttings passage. Cap 62 covers or closes the back end of passage 96. A plurality of exit holes or openings 98 may be formed in sidewall 86 adjacent rear end 90 extending from inner surface 94 to outer surface 92. Openings 98 are in fluid communication with passage 96 and interior chamber 84, outlet 44 and the passage defined by hose 46.

Figure 7:
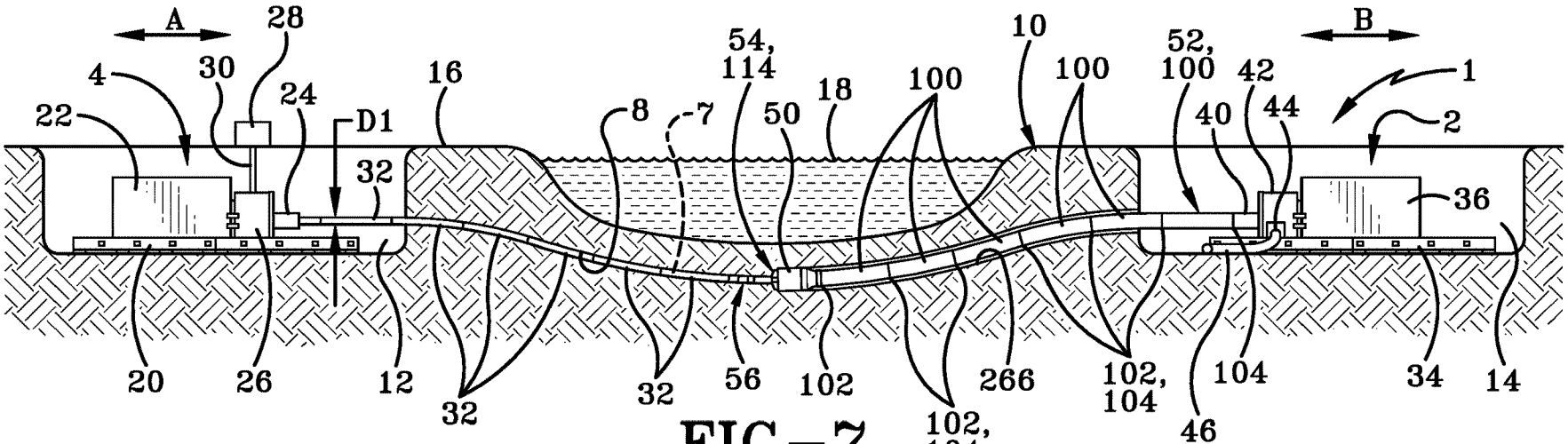
FIG. 7 is an operational view similar to FIG. 1 showing the reamer assembly having cut an enlarged borehole which is larger than and follows the path of the pilot hole.

With continued reference to FIG. 3 and additional reference to FIGS. 1 and 7, casing section 52 may include a plurality of smaller diameter casing segments 100 which may be secured in an end-to-end fashion such that the casing section 52 extends between and is secured to the larger diameter section 50 and rearmost segment 40, or to coupler 60 inasmuch as segment 40 may be deemed to be part of the narrower diameter section. Each segment 100 has a front end 102 and a back end 104 such that the back ends 104 are secured to respective front ends 102 of other segments 100 and the back end 104 of the rear segment 100 secured to front end 88 of casing segment 40. Each segment 100 may have a cylindrical sidewall 106 which defines front and back ends 102 and 104 and which includes cylindrical outer and inner surfaces 108 and 110. Outer surface 108 of each segment 100 has an outer diameter D3. Inner surface 100 defines a casing segment cuttings passage 112 extending from front end 102 to back end 104 and having an inner diameter D5. The various cuttings passages 112 of segments 100 are in fluid communication with one another and with passage 96 of segment 40, as well as openings 98, interior chamber 84, outlet 44 and the hose 46 passage. During different stages of the underground boring process, different numbers of casing segments 100 may be used and secured to one another. Initially, only one or two segments 100 may form part of casing 48, whereas later in the process, casing 48 may include at least 5, 10, 15, 20, 25, 30, 35, 40, 45 or 50 or more segments 100.

Figure 4:
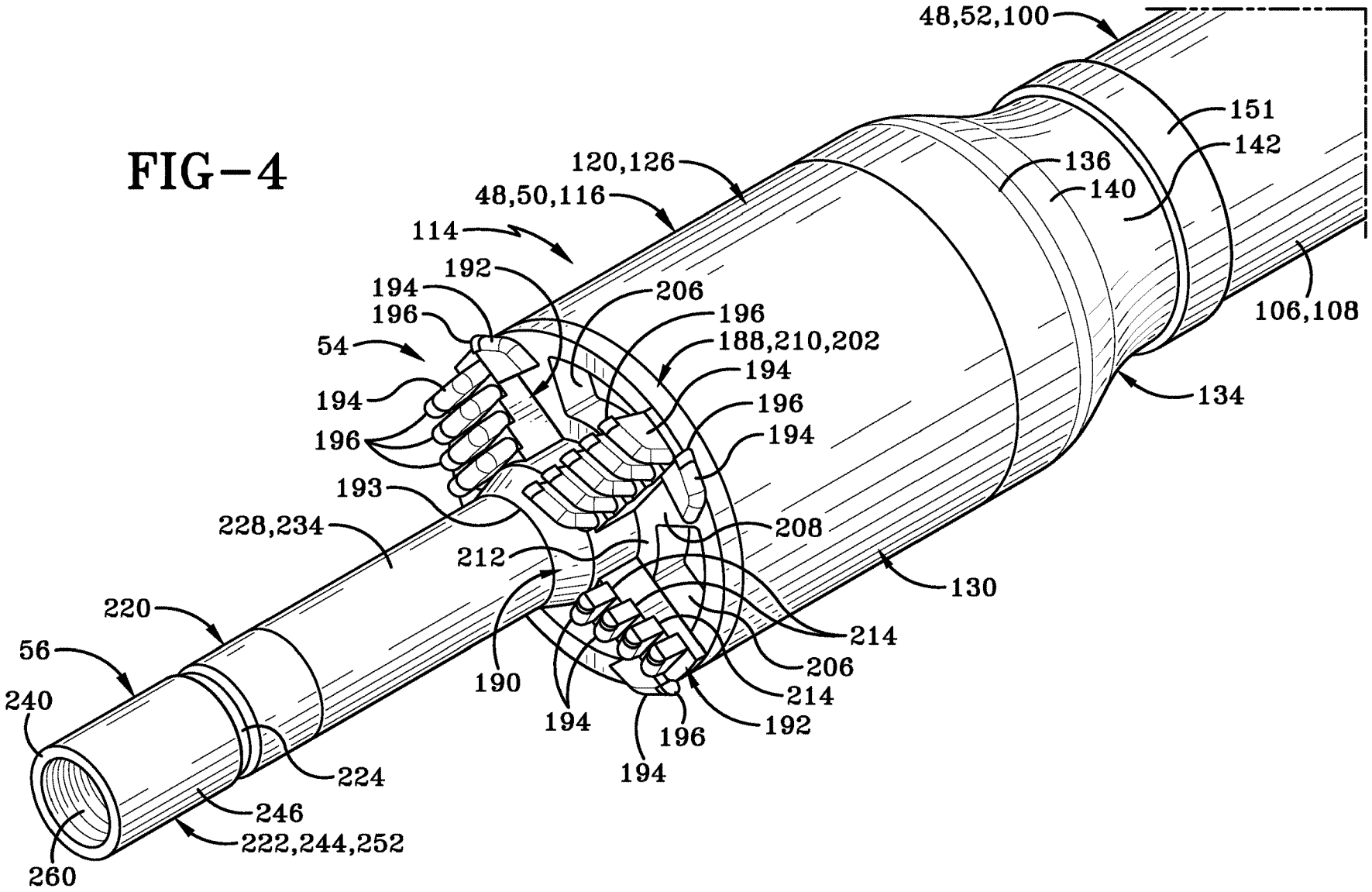
FIG. 4 is an enlarged perspective view of the cutting head region.
Figure 5:
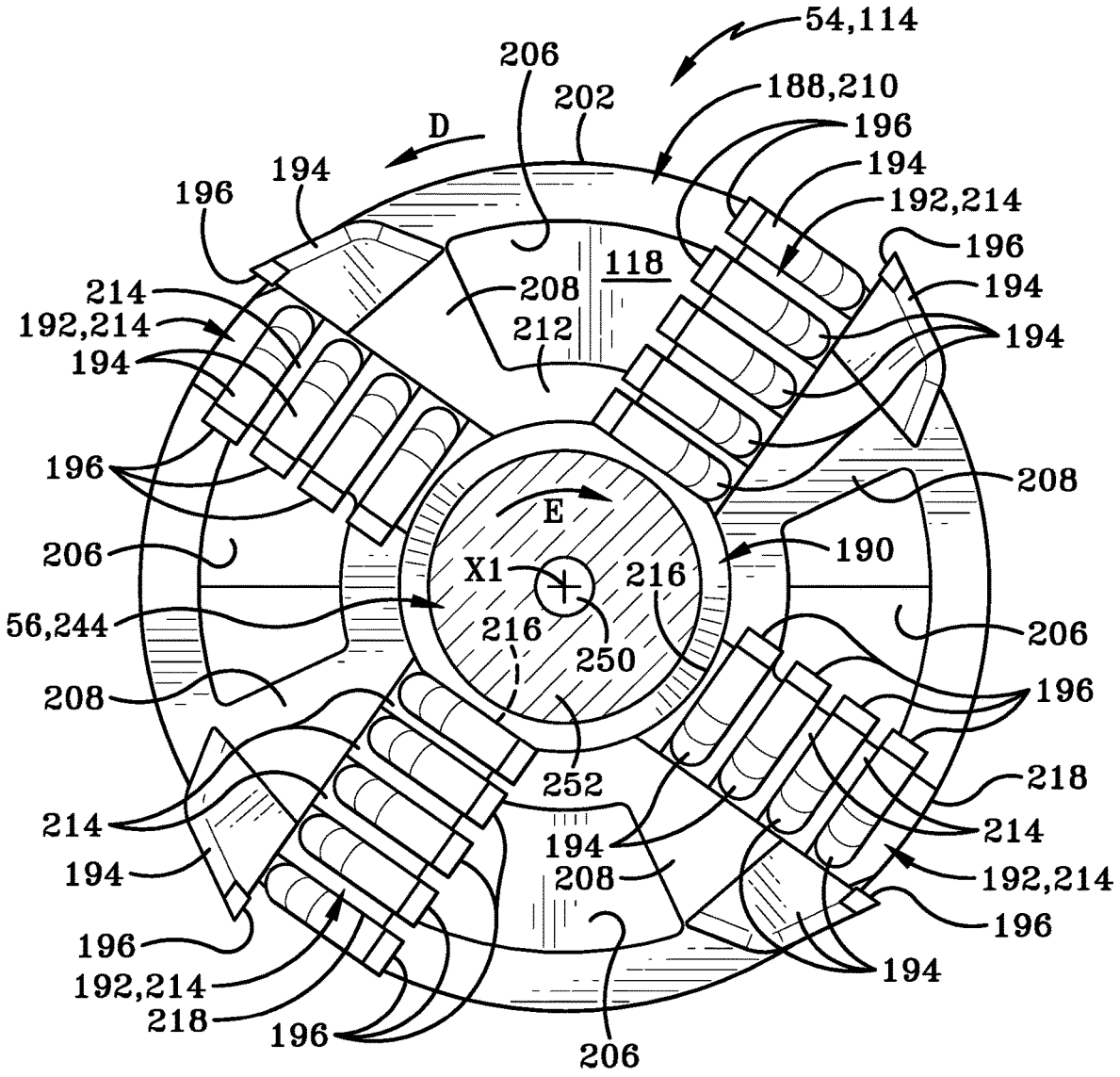
FIG. 5 is an enlarged sectional view taken on line 5-5 of FIG. 2 showing a cross-sectional view of a portion of the swivel and a front end elevation view of the cutter head.
Figure 6:
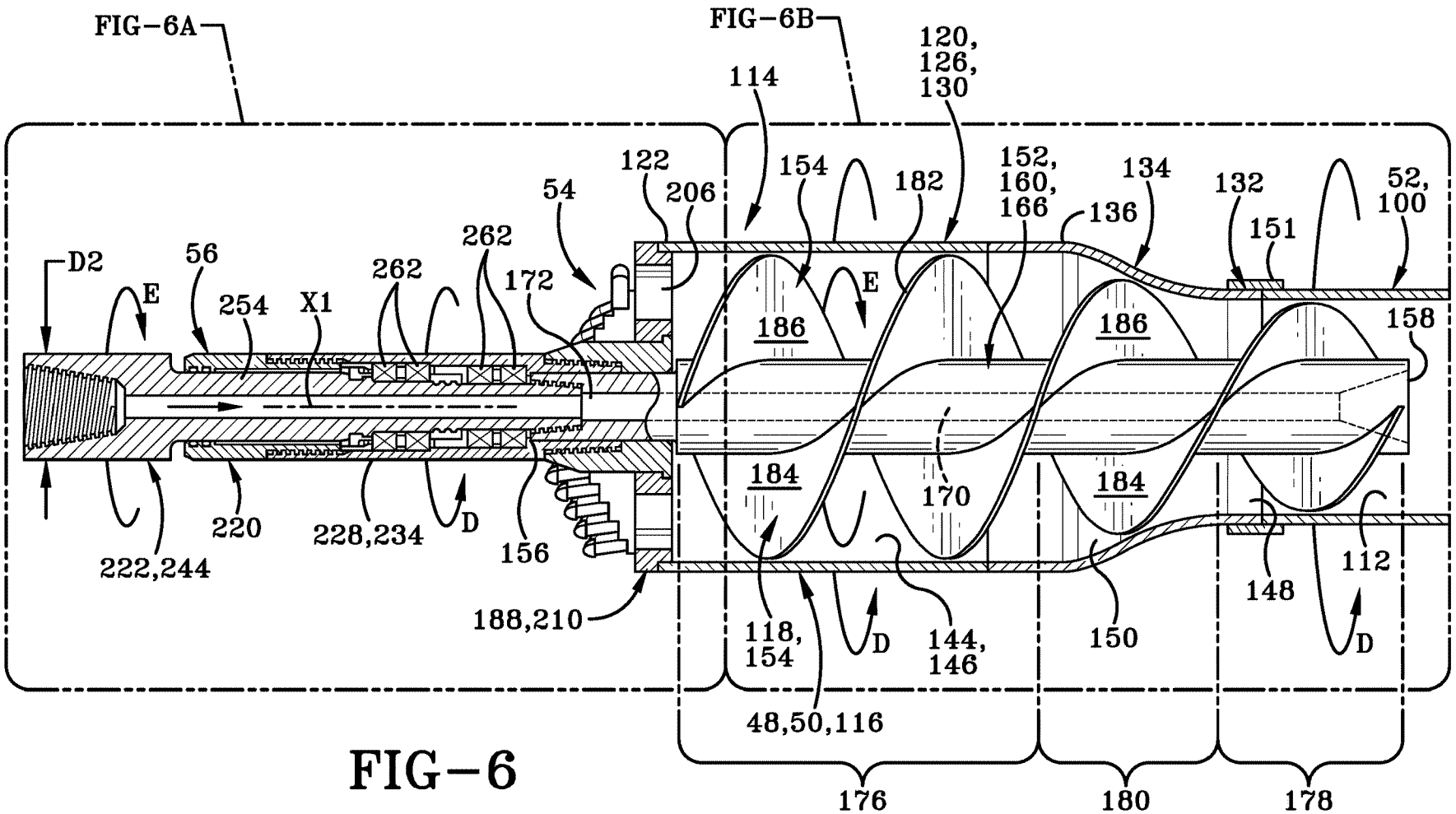
FIG. 6 is a longitudinal sectional view showing the swivel, cutter head and portions of the casing in section with the auger shown in a side elevation view.

With primary reference to FIGS. 4-6B, system 1 may include a reamer or reamer assembly 114 which may include cutter head 54 and a front casing segment 116 which defines or includes larger diameter front section 150. An auger 118 (FIG. 6) may extend within section 50 and a front portion of section 52. Reamer 114 is rotatable about a central longitudinal axis X1 (FIG. 6). More particularly, front casing segment 116 is rotatable about axis X1 together with cutter head 54, an outer portion of swivel 56 and the front segment 100 of section 52. Auger 118 is likewise rotatable about axis X1 together with an inner portion of swivel 56 independently of the rotation of segment 116, cutter head 54, the outer portion of swivel 56 and the front segment 100. Sidewall 106 including outer and inner surfaces 108 and 110 may be concentric about axis X1. Casing segment 116, auger 118, swivel 56, cutter head 54, wider section 50 are or may be distal the rear end of casing 48, casing segment/connector 40 and rig 2 including box 42, cap 62, coupler 60, drive shaft 38, engine 36 and tracks 34.

Front casing segment 116 may include an annular sidewall 120 generally having a circular cross section, a front end 122 and a back end 124. Sidewall 120, which may be formed of one or more annular pieces or segments, may further include annular outer and inner surfaces 126 and 128 which extend from front end 122 to back end 124. Sidewall 120 may include a front larger diameter cylindrical portion 130, a back or rear smaller diameter cylindrical portion 132 and a tapered portion 134 which extends rearwardly from a back end 136 of portion 130 to a front end 138 of portion 132. Outer surface 126 faces generally radially outwardly away from axis X1, while inner surface 128 faces radially inwardly toward axis X1. Outer and inner surfaces 126 and 128 along the length of front section 130 and along the length of section 132 may be essentially parallel to axis X1 and to one another. Sidewall 120 in section 130, sidewall in section 132, outer and inner surfaces 126 and 128 of section 130, and outer and inner surfaces 126 and 128 of section 132 may be concentric about axis X1.

Outer surface 126 along tapered portion 134 faces radially outwardly and rearwardly. Inner surface 128 along tapered portion 134 faces radially inwardly and forward. Tapered section 134 may include a front curved segment 140 (FIG. 6B) extending rearwardly from back end 136 of portion 130 and a rear curved segment 142 extending forward from the front end 138 of back portion 132. As shown in FIG. 6, outer surface 126 along front curved segment 140 may be convexly curved as viewed from the side of the reamer, whereas outer surface 126 along rear curved segment 142 may be concavely curved as viewed from the side. Inner surface 128 along front segment 140 may be concavely curved as viewed from the side in a longitudinal section (such as shown in FIG. 6), whereas inner surface 128 of rear segment 142 may be convexly curved as viewed from the side as seen in a longitudinal section such as FIG. 6. Inner surface 128 defines a casing segment cuttings passage 144 which may also be referred to as an auger receiving passage and which extends from front end 122 to back end 124. Passage 144 may include a wider or larger diameter portion 146 extending from the front end 122 to the back end 136 of front portion 130, a narrower or smaller diameter portion 148 extending from the front end 130 of back portion 132 to back end 124, and a tapered portion 150 extending from back end 136 to front end 138. An annular collar 151 may encircle or surround a rear portion of back portion 132/segment 116 adjacent back end 124 and a front portion of frontmost casing 100 adjacent front end 102 to help rigidly secure frontmost casing segment 100/narrower section 52 to segment 116/wider section 50. A plurality of fasteners (not shown) such as bolts or screws may extend through collar 151 and sidewalls 120 and 106 to secure collar 151, frontmost casing segment 100 and casing segment 116 to one another. Similar collars and fasteners may be used between adjacent pairs of casing segments 100 to secure a given front end 102 of one segment 100 to a given back end 104 of another segment 100, whereby such collars may be used to secure segments 100 in the end-to-end fashion shown in FIG. 7.

Inner surface 128 along front portion 130 defines an inner diameter D6 (FIG. 6B) of wider portion 146. Inner surface 128 along back portion 132 defines an inner diameter which may be the same as or essentially the same as diameter D5. The difference between diameters D6 and D5 may be the same as or fall in the same range as discussed with respect to the difference between diameters D4 and D3. Likewise, there may be a ratio of diameter D6 to diameter D5 which is the same as or within the same range as discussed with respect to the ratio of diameter D4 to diameter D3. Inner surface 128 along tapered portion 134 defines an inner diameter which is less than inner diameter D6 and greater than inner diameter D5.

Figure 6A:
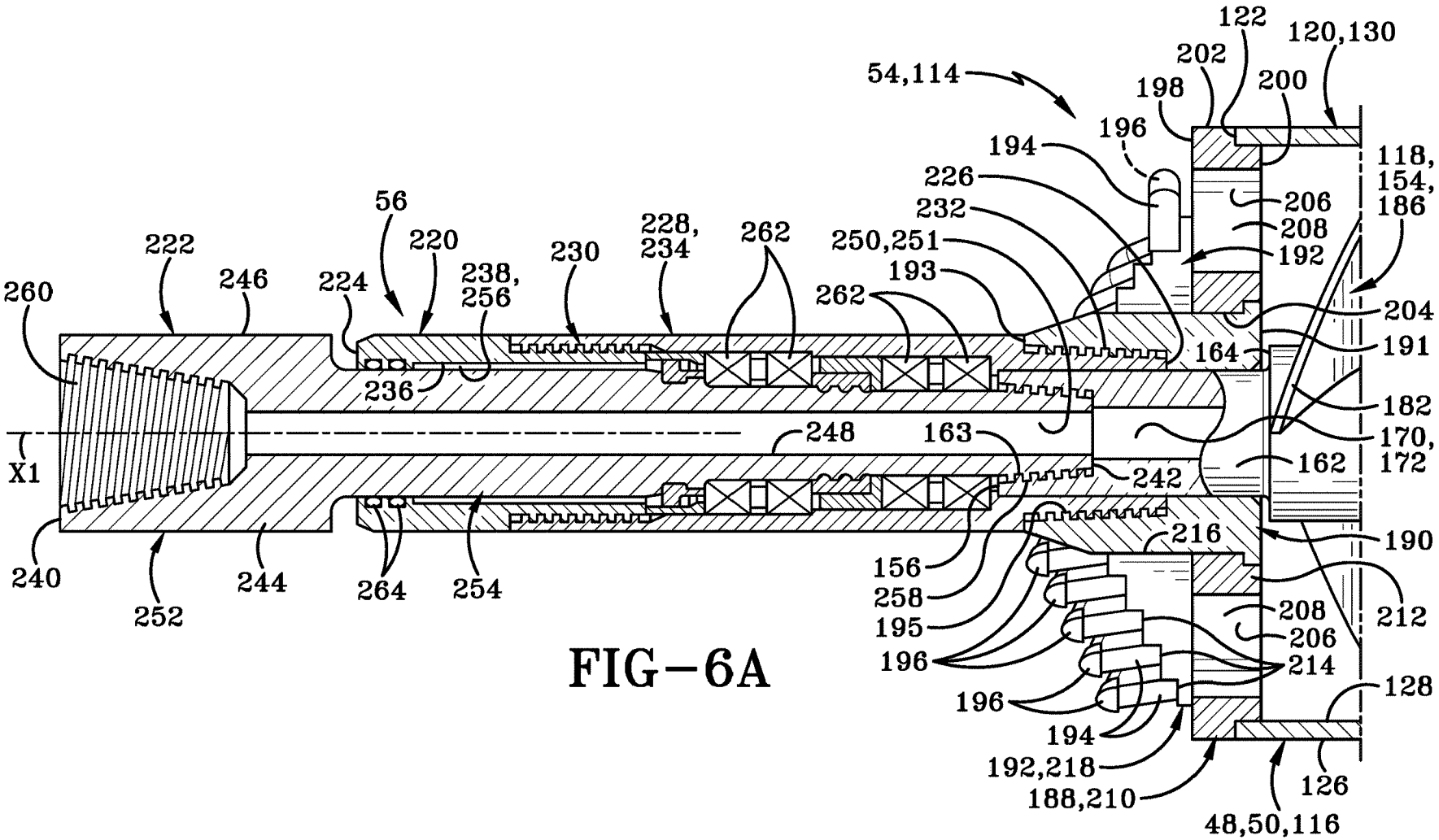
FIG. 6A is an enlarged sectional view of the encircled portion of FIG. 6 with reference line "FIG. 6A".
Figure 6B:
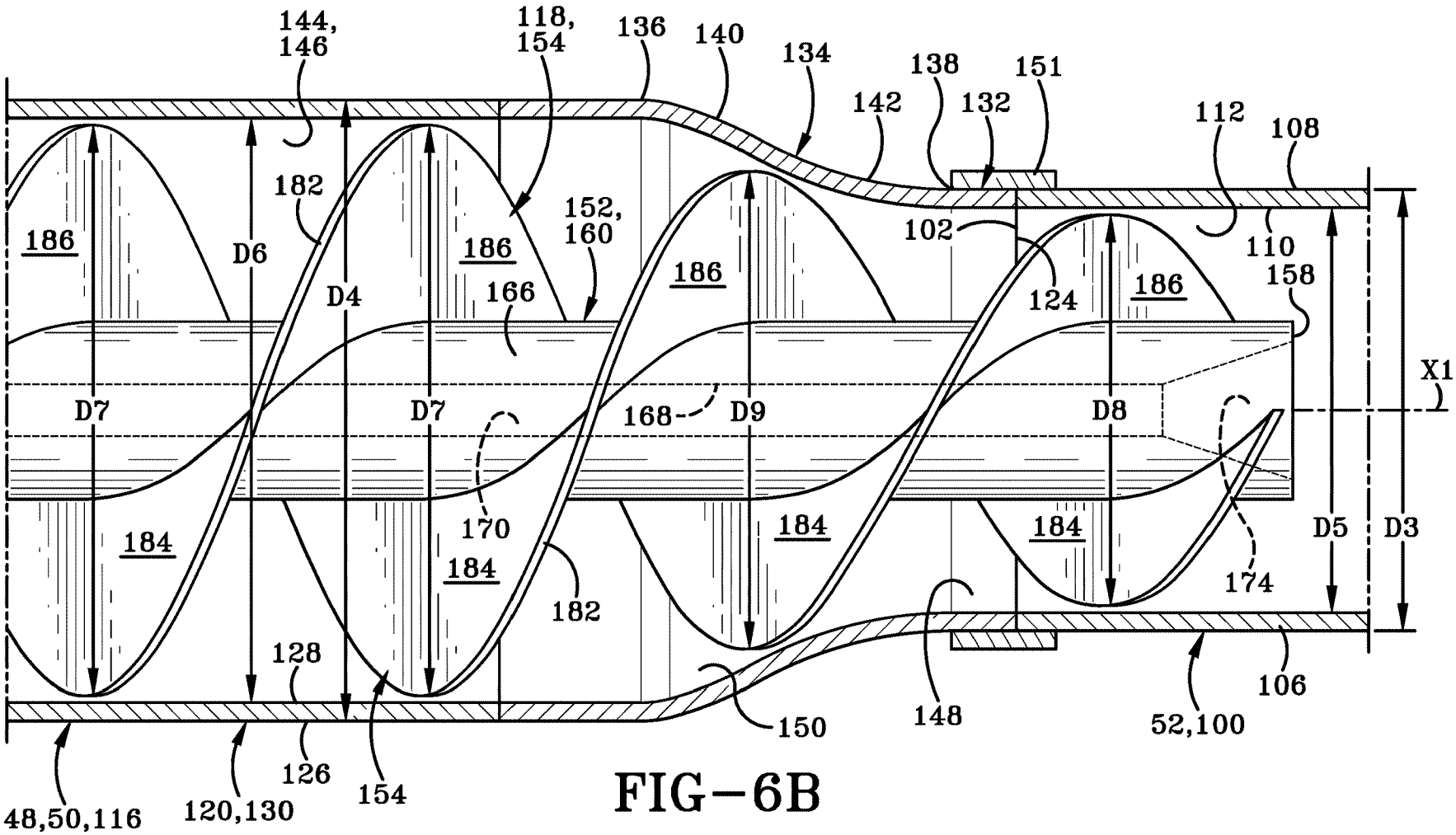
FIG. 6B is an enlarged sectional view of the encircled portion of FIG. 6 with reference line "FIG. 6B".

With primary reference to FIGS. 6 and 6B, auger 118 may include a rigid auger shaft 152 and one or more helical auger flights 154 secured to shaft 152 and extending radially outwardly therefrom. Auger 118 has a front end 156 and a terminal rear or back end 158 such that shaft 152 extends from front end 156 to back end 158. Shaft 152 may include a wider or larger diameter segment 160 and a narrower or smaller diameter segment 162 (FIG. 6A) adjacent front end 156. Shaft 152 may include a shoulder or step 164 (FIG. 6A) which steps inwardly from wider segment 160 to narrower segment 162. Step 164 may serve as a front end of wider segment 160 and a back end of narrower segment 162 so that segment 160 extends from back end 158 to front end 164 and narrower segment 162 extends from back end 164 to front end 156. Narrower segment 162 may include an externally threaded section 163 adjacent the back end of segment 162. Shaft 152 has an outer surface 166 which is typically cylindrical and a typically cylindrical inner surface 168 (FIG. 6B) which defines an auger air passage 170 extending from front end 156 to back end 158 of shaft 152. Air passage 170 has a front entrance opening 172 adjacent front end 156 and a rear entrance opening 174 (FIG. 6B) at or adjacent rear end 158. Passage 170 is in fluid communication with cuttings passage 112 of the front segment 100 and the cuttings passage of smaller diameter rear section 52 of the casing, whereby passage 170 is likewise in fluid communication with openings 98, chamber 84, outlet 44 and hose 46 (FIG. 3). Each helical flight 154 is secured to and extends radially outwardly from outer surface 166 of wider segment 160 and may extend from adjacent front end 164 to adjacent back end 158. Flights 154 may generally follow the contour of inner surface 128 of casing segment 116 and thus have a wider or larger diameter front section 176, a narrower rear section 178 and a tapered or intermediate section 180 which extends from the back of front section 176 to the front of rear section 178. More particularly, each helical flight 154 extends radially outwardly from outer surface 166 of segment 160 to an outer terminal helical edge 182 which may extend continuously from the front of the flight to the back of the flight. Each flight 154 may have a forward facing front face 184 which extends from outer surface 166 and the inner edge of a given flight to the helical edge 182 of the given flight. Likewise, each flight 154 may have a rearwardly facing rear face 186 which extends outwardly from outer surface 166 and the inner edge of the given flight to the outer helical edge 182 of the given flight. Each of faces 184 and 186 may have a helical configuration.

Helical edge 182 along wider front section 176 and along narrow back portion 132 may be concentric about axis X1. Helical edge 182 along wider front section 176 may define an outer diameter D7 (FIG. 6B) which is slightly less than inner diameter D6 such that this portion of outer helical edge 176 is closely adjacent or in contact with inner surface 128 of front portion 130. Helical edge 182 along narrow back portion 132 and the front region of the frontmost casing segment 100 may define an outer diameter D8 (FIG. 6B) which is slightly less than diameter D5 such that helical edge 182 of rear section 178 is closely adjacent or in contact with inner surface 128 of back portion 132 and/or inner surface 110 of the frontmost casing segment 100. Helical edge 182 tapers inwardly and rearwardly within tapered section 180 from the rear of wider section 176 to the front of narrower section 178 so that this portion of helical edge 182 defines an outer diameter D9 (FIG. 6B) which may vary and which is slightly less than the inner diameter defined by inner surface 128 of tapered portion 134, whereby helical edge 182 within tapered section 180 is closely adjacent or in contact with inner surface 128 of tapered segment 134. Diameters D8 and D9 are thus less than diameter D7, and diameter D8 is less than diameter D9. The difference between diameters D7 and D8 may be the same as or fall in the same range as discussed with respect to the difference between diameters D4 and D3. Likewise, there may be a ratio of diameter D7 to diameter D8 which is the same as or within the same range as discussed with respect to the ratio of diameter D4 to diameter D3.

With primary reference to FIGS. 4, 5 and 6A, cutter head 54 may include a base plate 188, a swivel mount 190, a plurality of cutter tooth mount blocks 192, a plurality of cutter teeth 194 wherein each tooth 194 includes a cutting tip or face 196. Base plate 188 may have front and back surfaces 198 and 200 which may be parallel to one another and perpendicular to axis X1. Plate 188 has a circular or cylindrical outer surface or perimeter 202 which extends between surfaces 198 and 200 and may be concentric about axis X1. Casing segment 116 may be rigidly secured to plate 188 and extends rearwardly therefrom to rigidly secure segment 116/casing 48 to plate 188/cutter head 54. Wider portion 130 adjacent front end 122 may be secured to plate 188 along or adjacent outer perimeter 202. Outer surface 202 may define an outer diameter which may be the same as or similar to outer diameter D4 of wider front section 50. Thus, the differences between the outer diameter of plate 188 and diameter D3 of narrower back section 52 may be the same as or fall in the same range as discussed with respect to the difference between diameters D4 and D3. Likewise, the ratio of the outer diameter of plate 188 to diameter D3 may be the same as or within the same range as discussed with respect to the ratio of diameter D4 to diameter D3. Cutter head 54 may have an outer diameter similar to that of perimeter 202 (may be the same or slightly larger) such that the outer diameter of cutter head 54 and diameter D3 of narrower back section 52 may be the same as or fall in the same range as discussed with respect to the difference between diameters D4 and D3. The outer diameter of cutter head 54 is thus of course substantially greater than that of pilot tube outer diameter D1.

Plate 188 may define a central hole 204 extending from front surface 198 to back surface 200 and in which is received swivel mount 190. More particularly, swivel mount 190 is rigidly secured to plate 188 within hole 190 and extends forward outwardly from front surface 198. Swivel mount 190 may have a back end 191 which is adjacent or substantially flush with back surface 200 of plate 188. Mount 190 may have a front end 193 which is spaced forward of front surface 198 of plate 188. Mount 190 may have an internally threaded portion 195 extending rearwardly from front end 193. Plate 188 may define a plurality of cuttings passages or openings 206 extending from front surface 198 to back surface 200. Openings 206 may serve as front cuttings entrance openings of casing air passage or cuttings passage 144 adjacent the front end of casing 48 and communicate with cutter teeth 194 to allow cuttings from teeth 194/faces 196 to enter passage 144 through openings 206. Openings 206 may be circumferentially spaced from one another whereby plate 188 includes a plurality of radial arms 208 which are also circumferentially spaced from one another such that each arm 208 extends between an adjacent pair of openings 206 and each opening 206 extends between an adjacent pair of arms 208. Thus, openings 206 and arms 208 may circumferentially alternate. Plate 188 may further include an outer ring 210 which includes outer surface 202 and an inner ring 212 which defines hole 204. Each arm 208 is rigidly secured to and extends outwardly from inner ring 212 to a rigid connection with outer ring 210. Each opening 206 extends from an outer diameter or surface of inner ring 212 to an inner diameter or surface of outer ring 210 and from a radially extending surface of one arm 208 to a radially extending surface of the adjacent arm 208. In the sample embodiment, there are four openings 206 and four arms 208 although these numbers may vary. Entrance openings for the same purpose as openings 206 may be formed in sidewall 120 adjacent cutter head 54 and front end 122 of casing 48.

Mount blocks 192 may be rigidly secured to and extend forward from front surface 198 of respective arms 208. Each mount block 192 has a plurality of forward facing steps 214 and each mount block has a radial inner end 216 and a radial outer end 218 wherein inner end 216 may be adjacent or in contact with the outer perimeter of swivel mount 190. Steps 214 are positioned such that the closer the given step is to the inner end 216, the further forward that step is. Thus, the step which is closest to outer end 218 is the most rearward, with the next step 214 being further forward, the next or middle step being further forward and so forth such that the step closest to end 216 is furthest forward of the various steps.

While most of the cutter teeth 194 in the sample embodiment are shown secured to and extending forward from the forward facing steps 214, some of the cutter teeth may be secured adjacent one of the radially extending surfaces of a given mount block 192. These latter teeth 194 may be secured to a trailing radial surface of a given block 192 and may be spaced forward of and adjacent front surface 198 of outer ring 210. Most of the teeth 194 shown are also positioned radially inward of outer perimeter 202 although some of teeth 194 and cutting faces 196 extend radially outward beyond outer surface 202 and outer surface 126 of wider section 50, for example those teeth 194 which are secured to the trailing edge of each of blocks 192. Each of the cutting faces 196 shown faces in the direction of rotation of the cutter head 54, discharge casing 48 and outer portion of swivel 56 which occurs during the cutting operation and which is shown by Arrows D FIGS. 3, 5, 6 and 8.

Referring now to FIG. 6A, swivel 56 includes a first or outer portion 220 and a second or inner portion 222 which are rotatable relative to one another about axis X1. Outer portion 220 has a front end 224 and a back end 226 which may serve as the back end of swivel 56. Outer portion 220 includes a generally cylindrical sidewall 228 which defines front and back ends 224 and 226. Sidewall 228 may for example include two segments which are threadedly secured to one another at a threaded connection 230. Outer portion 220 may include an externally threaded portion 232 which threadedly engages internally threaded portion 195 of swivel mount 190 to form a threaded connection therebetween to mount outer portion 220 rigidly on swivel mount 190. Outer portion 220 extends forward from front end 193 of swivel mount 190. Outer portion 220 may have a cylindrical outer surface 234 which defines an outer diameter which may be the same as or substantially the same as diameter D2. Outer surface 234 may be concentric about axis X1. Outer portion 220 further includes an inner surface 236 extending from front end 224 to back end 226 to define a passage 238 likewise extending from front end 224 to back end 226. Passage 238 receives therein a portion of narrower segment 162 of shaft 152 such that the front end 156 of shaft 162 is forward of the rear end 226 of outer portion 220. Outer portion 220, cutter head 54, casing 48, segment/connector 40, cap 62, coupler 60, drive shaft 38 may be rotatable together as a unit.

Inner portion 222 has a front end 240 and a back end 242. Front end 240 may serve as the front end of swivel 56. Inner portion 222 includes a sidewall 244 which generally has a circular cross section, an outer surface 246 (which may be concentric about axis X1) and an inner surface 248 defining a swivel air passage 250 extending from front end 240 to back end 242. A rear portion of swivel air passage 250 and a front portion of auger air passage 170 may together serve as or represent a cutter head air passage 251 which extends rearward through cutter head 54. Passage 251 may extend from front end 193 of swivel mount 190 and cutter head 54 to back end or surface of plate 188 and cutter head 54. Passages 251, 250 and 170 are spaced from and separate from cuttings entrance openings or passages 206, which may be spaced radially outward of passages 251, 250 and 170. Axis X1 may pass through passages 7, 112, 144, 170, 250 and 251 while not passing through entrance openings 206. Having described the various passages thus far, it is noted that compressor 28, conduit 30, swivel 26, passage 7, passage 251, passage 250, passage 170, passage 112, passage 96, openings 98, chamber 84, outlet 44 and hose 46 are all in fluid communication with one another. Compressor 28 is in fluid communication with these various passages via the respective front ends thereof so as to move pressurized air rearward through the given air passage from the front end thereof to the back end thereof.

Sidewall 244 may include a wider front section 252 and a narrower rear section 254 which may be also termed an insert portion inasmuch as it is inserted or received within passage 238 of outer portion 220. Outer surface 246 of narrower section 254 and inner surface 236 of outer portion 224 defined therebetween an annulus 256 which is part of passage 238. Insert portion 254 may include an externally threaded portion 258 which extends forward from rear end 242 and which threadedly engages threaded section 163 of narrower segment 162 to form a threaded connection which rigidly secures inner portion 222 of swivel 56 to segment 162 of shaft 152 such that inner portion 222 extends forward from the front end of shaft 152. Wider section 252 of sidewall 244 may have an internally threaded portion 260 adjacent and extending rearwardly from front end 240 which is configured to threadedly engage a rear end or trailing end of pilot tube 6 to secure pilot tube 6 to portion 222 of swivel 56. One end, or a first or front end, of the pilot tube 6 may be at station 12/in pit 12 connected to output/connector 24, while the other end, or a second or rear end, of pilot tube 6 may be at station 14/in pit 14 connected to inner portion 222 of swivel 56 whereby pilot tube 6 is operatively connected or rotationally coupled to auger 118. Pilot tube 6, portion 222 of swivel 56 and auger 118 are rotatable together as a unit about axis X1 independently of or relative to and in opposite direction (Arrows E in FIGS. 5, 6 and 8) to outer portion 220, cutter head 54 and casing 48. The relative rotation may be facilitated by bearings 262 which are received within passage 238 and annulus 256 and extend from inner surface 236 to outer surface 246 of narrower section 254. Rotational output/connector 24, pilot tube 6 and inner portion 222 of swivel 56 may serve as a drive train extending between engine 22 and auger 118 for driving rotation of auger 118. Annular seals 264 may be provided between the inner and outer portions 220 and 222, such as shown in FIG. 6A between outer surface 246 of narrower section 254 and inner surface 236 of outer portion 220. The seals or O-rings 264 are shown adjacent front end 224 of outer section 220 and thus may form a seal between inner and outer portion 220 and 222 to minimize or prevent the entry of liquid or particles into passage 238 and annulus 256 which might cause damage to bearings 262 and other components of the swivel.

Referring again primarily to FIG. 6, auger 118 and its location are discussed in greater detail. Front end 164 of wider segment and the front end of the one or more flights 154 may be adjacent back end/surface of cutter head 54/plate 188. Auger 118 or a similar auger may extend only over a relatively short distance compared to the entire length of casing 48, which of course increases as the reaming process progresses. In order to minimize the substantial weight that would otherwise be provided by an auger extending the full length of casing 48, auger 118 may be essentially entirely within the front region of casing 48 and more particularly, wider segment 160 of shaft 152 and the one or more flights 154 may be entirely within the front region of casing 48. For example, segment 160 and the one or more flights 154 may be entirely within larger diameter section 50/portion 130, tapered portion 134 and the front region or portion of narrower section 52/frontmost segment 100/portion 132. Said another way, segment 160 and the one or more flights 154 may be entirely within wider portion 146, tapered portion 150 and the front region or portion of the narrower portion of cuttings passage 144 which may include narrower portion 148 and/or the front region or portion of passage 112 of frontmost casing segment 100. Auger 118 may be shortened such that segment 160 and the one or more flights 154 may be entirely within larger diameter section 50/portion 130 and tapered portion 134 or entirely within larger diameter section 50/portion 130. Said another way, segment 160 and the one or more flights 154 may be entirely within wider portion 146 and tapered portion 150 or be entirely within wider portion 146. Rear end 158 and rear entrance opening 174 of passage 170 may, for example, be adjacent (and rearward or forward of): tapered portion 134 including front and back ends thereof; narrower portion 132 including front and back ends thereof; the back end 136 of larger section 50/portion 130; the front end 102 or 138 of narrower section 52/frontmost segment 100; the back end 124 of casing segment 116/portion 132; narrow portion 148 and front and back ends thereof; tapered portion 150 and front and back ends thereof; the back end of wider portion 146; and the front end of the narrower cuttings passage of section 52 made up of passages 112. Back end 158 may be forward of the back end 104 (FIG. 7) of the frontmost casing segment 100, and may be distal said back end 104. It may be, for instance, that auger 118 extends rearwardly from front end 122 of casing 48/section 50/segment 116 no more than 5, 10, 15, 20, 25 or 30 feet. Similarly, auger 118 may, for instance, extend rearwardly from back surface or end 200 of cutter head 54/plate 188 no more than 5, 10, 15, 20, 25 or 30 feet. Back end 158 may be within a front region of casing 48 so that there is no auger within the casing rearward of the back end 158.

System 1 may be free of an auger or there may be no auger (which may include one or more helical auger flights and may include a shaft from which the one or more flights extend radially outwardly) which is within or extends through the passages 112 of casing segments 100 other than the frontmost segment 100, or in the case where auger 118 does not extend rearwardly into passage 112 of frontmost casing 100 and/or narrower portion 148 of passage 144, system 1 may be free of or not include such an auger which is within or extends through any of the passages 112 of casing segments 100 or the narrower passage of section 52 made up of said passages 112. System 1 may be free of or not include such an auger which is within or extends through casing 48/section 52 adjacent the rear end of casing 48/section 52 or adjacent casing segment/connector 40 and rig 2 including drive shaft 36, coupler 60, end/pushing cap 62, openings 98, discharge box 42 and tracks 34.

Figure 8:
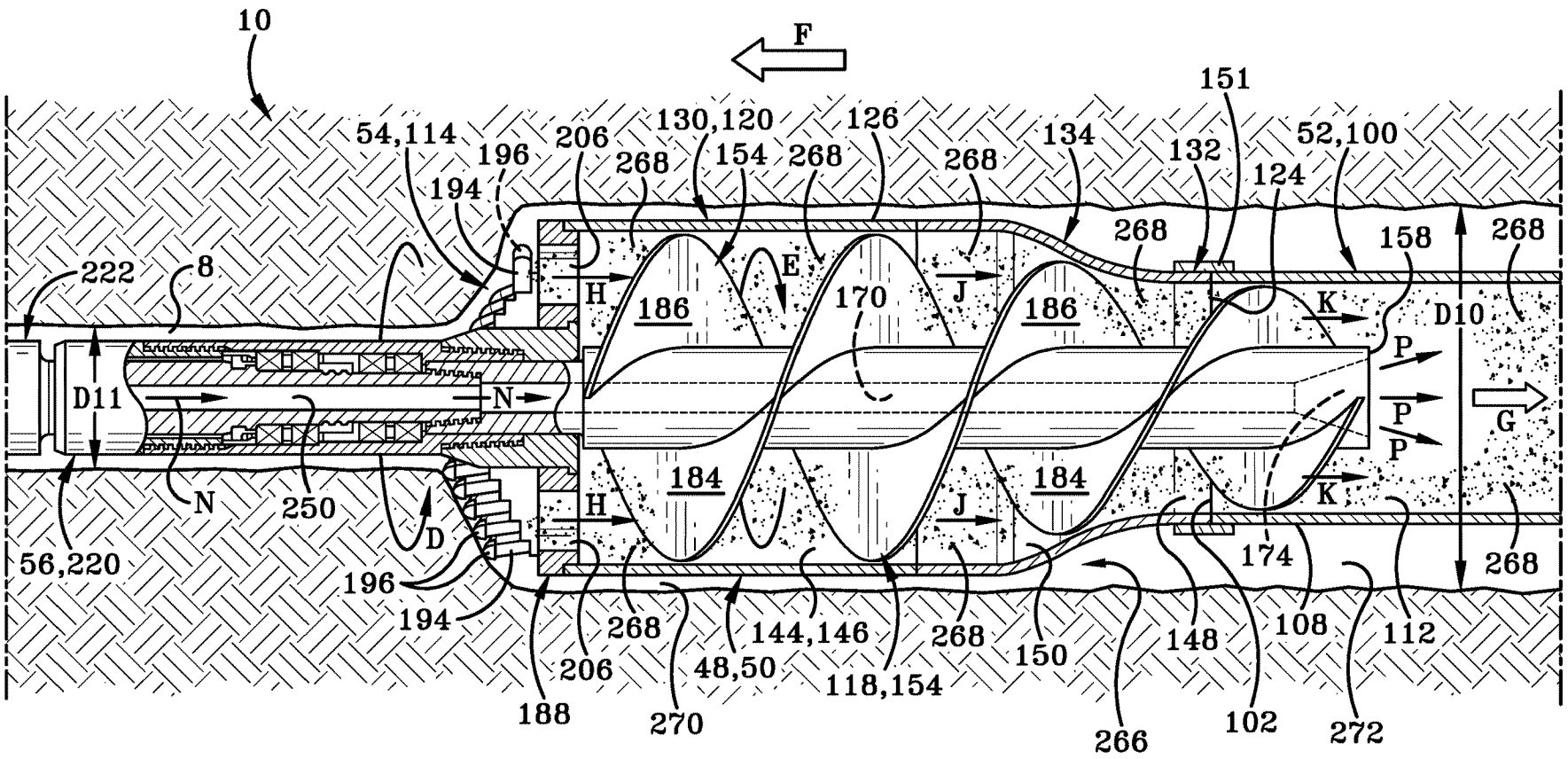
FIG. 8 is an enlarged operational view showing the operation of the reamer assembly in the cutting head region.

With primary reference to FIGS. 1, 7 and 8, the operation of system 1 is now described. As shown and discussed previously with respect to FIG. 1, pilot tube or drill string 6 may be used to form pilot hole 8. This may be done in any manner known in the art. Pilot hole 8 may be formed by forcing and/or drilling with pilot tube 6 from station 12 to station 14 or in the opposite direction from station 14 to station 12. Thus, rig 4 might be used to drive pilot tube 6 from station 12 to station 14, or rig 2 may be used to drive pilot tube 6 from station 14 to station 12. As is well-known, this would be done by adding pilot tube segments 32 in an end-to-end fashion as the pilot hole 8 became longer. Once pilot tube 6 has formed pilot hole 8 such that one end of pilot tube 6 is exposed at station 12 and the other end exposed at station 14, the end exposed at station 12 may be connected to the rotational output or connector 24 of rig 4, and the other end of pilot tube 6 at station 14 may be connected to the front end 240 of swivel 56 such as by a threaded engagement with threaded portion 260 of the swivel.

With the reamer 114 connected to the back end of the swivel 56 and with one or more casing segments 100 secured to the back of reamer assembly 114 and to the front of connector 40, engine 36 of rig 2 may be operated to drive rotation of drive shaft 36, coupler 60 and cap 62 (FIG. 3) as well as the rotation of connector 40, casing 48, cutter head 54 and outer portion 220 of swivel 56 in the cutting direction illustrated by Arrow D in FIG. 8. This rotation may be relative to auger 118, inner portion 222 of swivel 56 and pilot tube 6, which may be rotated in the opposite direction (Arrow E) at the same time by rotation of output/connector 24 when driven by engine 22 of rig 4. All of this rotational movement may occur during forward movement (Arrow F in FIG. 8) toward station 12. More particularly, this forward movement includes a forward movement of engine 36, box 42, connector 40, casing 48, reamer 114 including cutter head 54 and auger 118, swivel 56, pilot tube 6, engine 22, swivel 26 and connector 24. As this forward movement continues such that cutter head lengthens borehole 266, casing segments 100 are added to the back of section 52 to lengthen section 52 and casing 48. The rotation of cutter head 54 and forward movement thereof results in cutter head 54 cutting an enlarged borehole 266 (FIGS. 7, 8) which is larger than and follows pilot hole 8 and extends from station 14 to station 12 when completed. Like pilot hole 8, borehole 266 may be arcuate or curved such that holes 8 and 266 may have a shallow U-shaped configuration such that they angle downwardly from one or both ends so as to pass under obstacle 18 whereby one or both ends of holes 8 and 266 may be higher than the portion which passes beneath obstacle 18.

Borehole 266 has a diameter D10 which is larger than a diameter D11 of pilot hole 8, as shown in FIG. 8. The above noted rotation and forward movement may be achieved or effected by rig 2 rotating and pushing (or applying a forward force to) the rear end of casing 48 (such as with drive shaft 38, coupler 60, pushing cap 62 and/or segment 40) and may be aided by rig 4 pulling pilot tube 6 to in turn pull swivel 56, reamer 114 including cutter head 54 and segment 116, casing 48, etc. Usually, all or most of this forward movement is effected or driven by rig 2 via said pushing or application of forward force, and all of this rotation is effected or driven by rig 2 via rotation of drive shaft 38, coupler 60, pushing cap 62 and/or segment 40. The difference between diameters D10 and D3 of narrower section 50/segments 100 may be the same as or fall in the same range as discussed with respect to the difference between diameters D4 and D3. Likewise, there may be a ratio of diameter D10 to diameter D3 which is the same as or within the same range as discussed with respect to the ratio of diameter D4 to diameter D3.

During the cutting process and as shown in FIG. 8, cuttings 268 produced by the cutting engagement of cutter head 54 with ground 10 in forming borehole 266 may be moved rearwardly (Arrow G in FIG. 8) through discharge casing 48 and as shown by various arrows in FIG. 3, through passage 96 of casing segment 40 and out of passage 96 through openings 98 into interior chamber 84 and out of chamber 84 through outlet 44 and hose 46. The rearward or discharging movement generally indicated by Arrow G in FIG. 8 may include more specifically rearward movement of cuttings 268 from adjacent cutting teeth 194 through openings 206 in base plate 188 (Arrows H in FIG. 8), through the portions 146, 148 and 150 of cuttings passage 144 (Arrows J in FIG. 8), through the narrower casing cuttings passage of narrower section 52 made up of the various casing segment passages 112 (Arrows K in FIGS. 8 and 3), through and out of passage 96 via openings 98 (Arrows L in FIG. 3) into chamber 84, and out of chamber 84 via outlet 44 into hose 46 or the like as shown at Arrows M in FIG. 3. This rearward or discharge movement of cuttings 268 may be facilitated or effected by rotation of auger 118 (Arrow E in FIG. 8) and rearward movement of pressurized air from air compressor 28 (FIG. 7) through conduit 30, swivel 26, connector 24, pilot tube 6, swivel 56, auger 118 and the cuttings discharge passage of casing 48, such as the narrower cuttings passage of section 52 formed of passages 112 and downstream or rearward thereof through passage 96, openings 98, chamber 84, outlet 44 and hose 46 as shown in FIG. 3. The rearward flow of compressed air is thus also represented in FIG. 3 at Arrows K, L and M. In addition, FIG. 8 illustrates air flow at Arrows N and P wherein Arrows N illustrate the rearward flow of compressed air through air passage 250 of swivel 56 and air passage 170 of auger 118, and Arrows P illustrate the rearward flow of compressed air out of the exit opening 174 of passage 170 adjacent rear end 158 of auger 118 and into the cuttings passage of casing 48, which may in particular be the narrower cuttings passage defined by segment passages 112. Cuttings 268 may slide along the tapered inner surface 128 of tapered portion 134 to facilitate rearward movement into narrower portion 132/section 52. Rotation of casing 48 may include rotation of the rear end of the casing within interior chamber 84 of a box 42 while cuttings 268 are discharged out of the rear end of the casing via openings 98 into chamber 84.

Where auger 118 is used, the rotation of auger 118 may facilitate the rearward movement of cuttings 268 through portions 146, 148 and 150 of passage 144 and the front portion of the passage defined by narrower section 52, which may be the front portion of passage 112 of the frontmost casing 100. In the sample embodiment, a forward or front portion of cuttings 268 may be disposed within portions 146, 148 and 150 as well as the front section of passage 112 of the frontmost casing 100 forward of the back end 158 of auger 112 and the exit opening of passage 170 such that compressed air enters the cuttings passage defined by casing 48 rearward of this forward or front portion of the cuttings 268. Rotation of auger 118 may push, force or deliver cuttings 268 rearwardly to the region adjacent back end 158 so that the pressurized air exiting rear entrance opening 174 into the cuttings passage of casing 48 and shown at Arrows P in FIG. 8 forces cuttings 268 rearward of back end 158 rearwardly through the cuttings passage for discharge out of the rear end of casing 48 and from system 1, such as through passages 112 and 96, openings 98, chamber 84, outlet 44 and hose 46. In the sample embodiment, compressed air performs the vast majority of movement of cuttings 268 rearwardly to discharge them.

Compressor 28 may compress air to produce the above noted pressurized air at a pressure which may vary according to the requirements. By way of example, this pressure may be at least 200, 250, 300 or 350 pounds per square inch (psi) and may be more. Compressor or air pump 28 may also deliver or cause the pressurized air to flow rearwardly through pilot tube 8, swivel 56, auger 118, casing 48 and beyond at a rate which may be at least 700, 750, 800, 850, 900, 950, 1000, 1050 or 1100 cubic feet per minute (cfm) or more if needed or suitable.

Although system 1 may pump drilling fluid through the various air and cuttings passages instead of air (whereby these passages may be fluid or liquid passages), the use of air avoids problems such as those discussed in the Background section herein. Thus, system may be configured to eliminate or essentially eliminate the use of drilling fluid for use with cutter head 54 and/or for use in discharging cuttings 268. Thus, for instance, moving the pressurized air rearwardly through pilot tube air passage 7, swivel air passage 250, auger air passage 170, casing air passage/cuttings passage 112, air passage/cuttings passage 96, discharge openings 98, interior chamber 84, outlet 44 and so forth may be achieved without (or essentially without) moving drilling fluid or discharge fluid rearwardly through the same, wherein such drilling fluid or discharge fluid may be in the form of liquid water (i.e. water in its liquid state), a bentonite slurry (which normally would include liquid water), liquid polymers, or any other liquid, aside from any liquid which may form within these various passages etc. by condensation (e.g., gaseous water from air in the passages condensing to form liquid water) or incidental leakage which might occur at joints or connections between pilot tube segments 32 or other components such that water/other liquid outside the pilot tube or other components might enter the passages etc.

While water or other liquid occurring naturally in ground through which the cutter head cuts the borehole may inherently be adjacent or in contact with the cutter head and facilitate the reaming or cutting process, the reaming process may occur without delivering such a drilling fluid or discharge fluid adjacent or into contact with the cutter head, such as may occur in many processes to facilitate cutting and/or entraining cuttings therein for discharge out of the borehole along a path inside a casing or outside of a casing, such as in an annulus around the casing. Thus, the rotation and forward movement of the cutter head and casing to cut the borehole may occur without delivering a liquid adjacent or into contact with the cutter head other than liquid occurring naturally in ground through which the cutter head cuts the borehole. It may be that such drilling fluid or discharge fluid is not delivered through a conduit to adjacent the cutter head, such as a passage formed in the pilot tube, a passage within the casing, a conduit outside the casing, or through an annulus within the borehole around the casing defined between the outer surface of the casing and the inner surface defining the borehole. System 1 may thus be configured so that none or essentially none of the cuttings created by the cutter head are discharged from the casing or borehole using a liquid or fluid (such as those noted above), or said in another way, so that no liquid or fluid, or essentially no liquid or fluid, is used to entrain and/or force, discharge or remove such cuttings from the casing or borehole, other than the above-noted liquid occurring naturally in the ground (which might enter the cuttings passage via entrance openings 206), condensation or inadvertent leakage at joints between components.

The ability to avoid the use of drilling fluid as discussed above eliminates the frac-out problems noted in the Background section herein. In addition, the elimination of frac-out problems allows for the ability to drill shorter boreholes because the borehole can be cut closer to a given obstacle 18. That is, the borehole need not extend as far down or deep into the earth, thereby substantially decreasing the required borehole length at substantial cost savings. The ability to drill shallower boreholes also often avoids or minimizes the necessity of drilling through rock.

The use of casing 48 during rotation thereof may also vastly reduce the friction between the outer surface of the casing and the inner surface defining borehole 266 which would occur with a casing of having a diameter of larger casing section 50 because a large portion of outer surface 108 of narrower section 52 does not engage the inner surface defining borehole 266, even when the borehole is curved. Once borehole 266 is completed to extend from station 12 to station 14, final product pipe or casing may be installed in borehole 266 in any manner known in the art. Such pipe may, for instance, have an outer diameter D4 or a diameter greater than diameter D3 and less than diameter D4. In addition, in some situations, casing segments 100 may also serve as the final product installed within borehole 266.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration set out herein are an example and the invention is not limited to the exact details shown or described.

The invention claimed is:

1. A method comprising steps of:

rotating and moving forward a cutter head and a casing extending rearwardly from the cutter head to cut an underground borehole;

providing a source of pressurized air for discharging cuttings cut by the cutter head out of a rear end of the casing;

introducing pressurized air from the source of pressurized air into the front end of the cutter head;

causing the pressurized air to flow in a direction from the front end of the cutter head toward a rear end of the cutter head;

moving the pressurized air rearwardly through a cutter head air passage formed in the cutter head and through a casing cuttings passage formed in the casing;

discharging the cuttings created by the cutter head out of the rear end of the casing using only the pressurized air from the source of pressurized air;

wherein the step of moving the pressurized air comprises moving the pressurized air rearwardly through a swivel air passage formed in a swivel which is located forward of and adjacent the front end of the cutter head.

2. The method of claim 1 further comprising the step of driving the rotation of the cutter head and casing with a rotational output of an engine adjacent the rear end of the casing.

3. The method of claim 1 wherein the step of rotating and moving forward the cutter head and casing comprises pushing the rear end of the casing.

4. The method of claim 1 wherein rotation of the cutter head and casing comprises rotation of the rear end of the casing within an interior chamber of a box while the cuttings are discharged out of the rear end of the casing into the interior chamber of the box.

5. The method of claim 1 wherein the step of moving pressurized air comprises moving pressurized air rearwardly through an auger air passage formed in an auger which is within the casing.

6. The method of claim 1 wherein there is no auger in the casing adjacent the rear end of the casing.

7. The method of claim 1 wherein the step of moving the pressurized air occurs essentially without moving a liquid rearwardly through the cutter head air passage into the casing cuttings passage.

8. The method of claim 1 wherein the step of rotating and moving forward occurs without delivering a liquid to the cutter head other than liquid occurring naturally in the ground through which the cutter head cuts the borehole.

9. The method of claim 1 wherein other than liquid occurring naturally in ground through which the cutter head cuts the borehole, essentially no liquid is used to discharge from the borehole cuttings created by the cutter head.

10. The method of claim 1, further comprising:

locating the source of pressurized air forwardly of the front end of the cutter head; and only moving the pressurized air through the cutter head and casing in a single direction from the front end of the cutter head through to the rear end of the casing.

11. A method comprising steps of:

providing a pilot tube within an underground pilot hole having a pilot hole diameter;

rotating and moving forward a cutter head and a casing extending rearwardly from the cutter head to cut an underground borehole; wherein the borehole follows the pilot hole and has a borehole diameter larger than the pilot hole diameter;

providing a source of pressurized air for discharging cuttings cut by the cutter head out of a rear end of the casing;

introducing pressurized air from the source of pressurized air into a front end of the cutter head through the pilot tube;

causing the pressurized air to flow in a direction from the front end of the cutter head toward a rear end of the cutter head;

moving the pressurized air rearwardly through a cutter head air passage formed in the cutter head and through a casing cuttings passage formed in the casing;

discharging the cuttings created by the cutter head out of the rear end of the casing using only the pressurized air from the source of pressurized air; and wherein the step of moving the pressurized air comprises moving the pressurized air rearwardly from the source of pressurized air and through a pilot tube air passage formed in the pilot tube that is located forwardly of the front end of the cutter head.

12. The method of claim 11, further comprising the step of rotating the pilot tube to rotate an auger within the casing.

13. The method of claim 11, wherein the auger has an auger terminal back end which is within a front region of the casing so that there is no auger within the casing rearward of the auger terminal back end.

14. The method of claim 11, wherein the casing has a larger diameter front casing section and a smaller diameter rear casing section which is rearward of the front casing section and has a front end; and the auger has an auger terminal back end which is adjacent the front end of the smaller diameter rear casing section so that there is no auger within the casing rearward of the auger terminal back end.

15. The method of claim 12, wherein the auger has a larger diameter front segment and a smaller diameter rear segment.

16. The method of claim 15, wherein the auger has a tapered segment between the front segment and the rear segment.

17. The method of claim 15, wherein the casing has a larger diameter front casing section and a smaller diameter rear casing section rearward of the front casing section; and the front segment of the auger is in the front casing section and the rear segment of the auger is in the rear casing section.

18. The method of claim 17, wherein the casing has a tapered section which is between the front casing section and the rear casing section and which tapers rearward and radially inwardly.

19. An apparatus comprising:

a source of pressurized air;

an earth-boring cutter head;

a swivel located forward of and adjacent a front end of the cutter head; said swivel being positioned between the source of pressurized air and the front end of the cutter head;

a swivel air passage formed in the swivel;

a cutter head air passage extending through the cutter head; said cutter head air passage being in fluid communication with the swivel air passage and thereby with the source of pressurized air, wherein the source of pressurized air is actuatable to cause pressurized air to flow through the swivel air passage and into the cutter head air passage;

a casing secured to the cutter head and extending rearwardly therefrom so that the casing and cutter head are rotatable together as a unit, the casing having a casing front end and a casing back end;

a casing cuttings passage which extends from adjacent the casing front end to adjacent the casing back end and which is in fluid communication with the cutter head air passage; and an entrance opening of the casing cuttings passage which is adjacent the cutter head, spaced from the cutter head air passage; wherein pressurized air flows from the source of pressurized air, through the swivel air passage, through the casing cuttings passage, through the entrance opening and into the casing cuttings passage, wherein only the pressurized air is utilized to cause cuttings from the cutter head to be discharged from the casing back end.

20. The apparatus of claim 19, further comprising:

a pilot tube located between the source of pressurized air and the swivel; and a pilot tube air passage formed in the pilot tube; said pilot tube air passage being in fluid communication with the swivel air passage and the source of pressurized air; and wherein the pressurized air flows rearwardly from the pilot tube air passage and into the swivel air passage.

21. The apparatus of claim 20, wherein the source of pressurized air is an air compressor located forward of and adjacent a leading end of the pilot tube; said air compressor being in fluid communication with the pilot tube air passage; wherein the air compressor is movable to an actuated condition to provide only pressurized air through the pilot tube air passage to the cutter head in order to discharge the cuttings from the cutter head.

22. The apparatus of claim 19, wherein the source of pressurized air is located forwardly of the front end of the cutter head and the pressurized air delivered by the source of pressurized air only moves in a single direction through the cutter head and casing, wherein the single direction is from the front end of the cutter head through to the rear end of the casing.

* * * * *